US009549571B2

(12) United States Patent
Magne

(10) Patent No.: US 9,549,571 B2
(45) Date of Patent: Jan. 24, 2017

(54) TREATMENT DEVICE FOR A SMOKING ARTICLE AND CARTRIDGE THEREFOR

(71) Applicant: PHILIP MORRIS PRODUCTS S.A., Neuchatel (CH)

(72) Inventor: Frederic Magne, Ursy (CH)

(73) Assignee: Philip Morris Products S.A., Neuchatel (CH)

( * ) Notice: Subject to any disclaimer, the term of this patent is extended or adjusted under 35 U.S.C. 154(b) by 80 days.

(21) Appl. No.: 14/353,088

(22) PCT Filed: Oct. 31, 2012

(86) PCT No.: PCT/EP2012/004550
§ 371 (c)(1),
(2) Date: Apr. 21, 2014

(87) PCT Pub. No.: WO2013/064247
PCT Pub. Date: May 10, 2013

(65) Prior Publication Data

US 2014/0283854 A1 Sep. 25, 2014

(30) Foreign Application Priority Data

Oct. 31, 2011 (EP) ..... 11008716

(51) Int. Cl.
*A24C 5/60* (2006.01)
*A24F 25/00* (2006.01)
*A24F 25/02* (2006.01)

(52) U.S. Cl.
CPC ..... *A24C 5/608* (2013.01); *A24F 25/00* (2013.01); *A24F 25/02* (2013.01)

(58) Field of Classification Search
CPC ..... A24C 5/608; A24F 25/00; A24F 25/02
(Continued)

(56) References Cited

U.S. PATENT DOCUMENTS 2,333,049 A 10/1943 Shapiro
3,732,872 A 5/1973 Lakritz
(Continued)

FOREIGN PATENT DOCUMENTS

CN 201607435 U * 10/2010 ..... G01N 15/08
CN 201607435 U 10/2010
(Continued)

OTHER PUBLICATIONS

Office Action issued in Japan for Application No. 2014-537520 dated Apr. 30, 2015, 7 pages. English translation included.
(Continued)

*Primary Examiner* — Anthony Calandra
(74) *Attorney, Agent, or Firm* — Mueting, Raasch & Gebhardt, P.A.

(57) ABSTRACT

The present invention relates to a treatment device for a smoking article, comprising a smoking article receiving portion shaped and configured to receive at least a portion of a smoking article, and a needle storage portion with a needle holder and a needle connected to the needle holder. The needle is movable between an extended position in which the needle extends at least partially into the smoking article receiving portion and a retracted position in which the needle is fully retracted into the needle storage portion with respect to the extended position, to protect an operator from the needle. The invention further relates to a cartridge for such a treatment device, wherein the cartridge comprises a treatment substance for a smoking article. The cartridge comprises a plunger receiving means which is adapted to receive a plunger to force the treatment substance out of the cartridge. The cartridge has at least one side wall which is adapted to be perforated by a second end of the needle, such that the second end of the needle may protrude into the
(Continued)

inside of the cartridge, wherein the treatment substance is stored.

16 Claims, 2 Drawing Sheets

(58) Field of Classification Search
USPC ..... 131/300
See application file for complete search history.

(56) References Cited

U.S. PATENT DOCUMENTS

| | | | | |
|---|---|---|---|---|
| 4,233,995 | A | 11/1980 | Kotuby | |
| 6,314,645 | B1 | 11/2001 | Wahl | |
| 6,562,011 | B1 * | 5/2003 | Buch-Rasmussen et al. | A61M 5/24 604/232 |
| 7,322,361 | B2 | 1/2008 | Grzonka | |
| 2004/0182405 | A1 | 9/2004 | Grzonka | |

FOREIGN PATENT DOCUMENTS

| | | | |
|---|---|---|---|
| DE | 10052408 | | 3/2005 |
| DE | 10052409 | C1 | 11/2011 |
| GB | 262003 | | 12/1926 |
| KR | 20060013199 | | 5/2006 |
| RU | 2067876 | | 10/1996 |
| WO | WO 98/02053 | | 1/1998 |
| WO | WO 2009/027832 | | 3/2009 |

OTHER PUBLICATIONS

Office Action issued in Russia for Application No. 2014121886/12 dated Jun. 15, 2015, 17 pages. English translation included.
PCT International Search Report for International Application No. PCT/EP2012/004550 dated Feb. 25, 2013 (3 pages).
Partial Search Report in Europe for European Application No. 11 00 8716 dated Mar. 19, 2012 (5 pages).
Extended Search Report in Europe for European Application No. 11008716.0 dated Jul. 23, 2012 (8 pages).
Office Action issued in China for Application No. 201280053198.9 dated Oct. 10, 2015, 14 pages. English translation included.

* cited by examiner

TREATMENT DEVICE FOR A SMOKING ARTICLE AND CARTRIDGE THEREFOR

This application is a U.S. National Stage Application of International Application No. PCT/EP2012/004550, filed Oct. 31, 2012, which was published in English on May 10, 2013, International Patent Publication WO 2013/064247 A1. International Application No. PCT/EP2012/004550 claims priority to European Application No. 11008716.0 filed Oct. 31, 2011.

The present invention relates to a treatment device for a smoking article, in particular a flavouring device.

Devices for treating smoking articles are known. For example, one known device for treating a cigarette includes a treatment device with a cigarette receiver with an open top. A needle is disposed centrally within the receiver for dispensing a treatment fluid throughout the tobacco of a cigar, cigarette or charge of pipe tobacco which is disposed in the receiver. The needle comprises several openings provided in a spaced relation to allow injection of fluid at several positions. Another similar device further includes a plunger as a means for applying the necessary pressure to deliver a fluid through the needle. An opening is provided only at the tip of the needle.

WO 2009/027 832 A2 discloses an apparatus for dispensing a metered amount of liquid to a cigarette filter, wherein the liquid is a flavor or sensory agent such as menthol. When a cigarette is pressed into the device, a pressurizing force is applied to a liquid in a reservoir, which is in turn injected into the filter through a hollow needle. The injection is effected at a discrete location in the filter.

However, these prior art devices only allow delivering the treatment fluid at discrete locations in the smoking article, such that the properties imparted by the fluid will vary along the smoking article. Furthermore, the needle always protrudes significantly into the smoking article receiving portion of the devices, such that a rather lengthy housing has to be provided to protect the operator of the device from the sharp end of the needle.

Furthermore, the injection of fluid in smoking articles is known during the mass production of cigarettes at a production site.

In this context, US 2004/0182405 A1 discloses a method for supplying a flowable medium to the tobacco rod of a smoking article, wherein the flowable medium may be flavor. Cigarettes are provided in a recess of a drum, and a hollow mandrel is inserted into each cigarette. When the hollow mandrel is retracted, a defined quantity of the medium is injected into the cigarette, wherein the supply of medium is effected by using a pump or rotational forces.

U.S. Pat. No. 3,732,872 discloses an apparatus for the uniform addition of soluble materials to cigarettes, wherein a syringe with a needle and plunger is secured to a carriage and then inserted into a cigarette, which is placed in a cradle. Through the needle solution is dispensed throughout the cigarette.

However, these devices are not suitable for the use by a consumer, as they are too complex or cannot be safely operated by the consumer.

Thus, it is an object of the invention to provide a treatment device for a smoking article, which allows a better distribution of the treatment fluid throughout the smoking article, while at the same time being compact and safe to operate.

According to the invention there is provided a handheld treatment device in which the needle is movable between an extended position in which the needle extends at least partially into the smoking article receiving portion and a retracted position in which the needle is fully retracted into the needle storage portion with respect to the extended position, to protect an operator from the needle. In particular, in the retracted position, the needle storage portion encloses the needle, such that the operator is prevented from touching the needle. Preferably, an enclosure may be provided around the needle, wherein the enclosure extends along the longitudinal length of the needle in its retracted position. The enclosure may be comprised of one or several walls, which may be curved or flat, and which extend substantially around the full circumference of the needle. Thus, by means of moving the needle the distance in between the extended position and the retracted position, the injection can be carried out along a portion of the smoking article without modifying the position of the smoking article.

A needle according to the present invention can be any dispensing element, which is adapted to extend into the smoking article storage portion to provide a treatment substance to a smoking article. In particular, the needle has at least one inner channel to provide the treatment substance to the smoking article. The needle may be tapered along at least a part of its longitudinal extension or may have a constant cross section. The needle may have a circular, cylindrical, rectangular, polygonal or any other cross section. The shape of the cross section may vary along the longitudinal extension of the needle. The needle may be substantially flat. The needle may be formed from any material, preferably metal or polymer material. In particular, a needle with a single opening at the tip can be provided, which nevertheless allows distribution of the treatment fluid along at least a portion of the length of the smoking article. Alternatively, it is also possible to provide a needle with a plurality of openings along its length (for example two, or more than two openings), such that with a shorter movement length a continuous distribution of a treatment substance can be obtained. The needle may be movable together with a needle holder or relative to a needle holder, as further discussed below.

The fact that the needle is retractable also has the benefit that the needle does not project at all from the needle storage portion when the needle is in the retracted position. In some embodiments the smoking article may protrude from the smoking article receiving portion into the needle storage portion, such that the needle is already slightly inserted in the smoking article, when the needle is still in the retracted position. In this way, the size of the smoking article receiving portion can be minimized, while still protecting the operator from the needle.

The retracted position corresponds to a position in which the needle is fully retracted into the needle storage portion, and, thus, the operator is already protected from the needle. This configuration is in particular beneficial for embodiments wherein the smoking article receiving portion and the needle storage portion can be moved relative to each other into a storage configuration of the treatment device. For example, the smoking article receiving portion and the needle storage portion can be folded relative to one another to reduce the size of the device. In this way, the retractability of the needle makes the treatment device more compact and, thus, easier to carry and store.

Due to the movement of the needle, the opening at the tip of the needle, or several openings along the length of the needle, will be moved within the smoking article such that the injection process is not only carried out at one or several discrete locations, but along a continuous line, or along a number of portions of the smoking article. Furthermore, in some of the preferred embodiments, the movement allows interaction with a cartridge having a plunger receiving means to force the flavouring substance out of the cartridge, as further discussed below.

The treatment device is handheld and accordingly it is sized such that it is possible to distribute to consumers, and consumers can carry the device with them to apply the treatment substance to smoking articles just before the consumption of the smoking article.

Smoking articles may be either combustible smoking articles or non-combustible smoking articles. Examples of combustible smoking articles are cigarettes or cigars. Combustible smoking articles may have a rod of smokable material and, optionally, a filter. As an example of a non-combustible smoking article, a number of smoking articles in which tobacco is heated rather than combusted have been disclosed. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. During smoking, volatile compounds are released from the aerosol forming substrate by heat and entrained in air drawn through the smoking article. As the released compounds cool, they condense to form an aerosol that is inhaled by the consumer. As another example of a non-combustible smoking article, smoking articles in which a nicotine-containing aerosol is formed from a tobacco material or other nicotine source without combustion and without addition of heat have been disclosed, such as those described in WO-A-2008/121610 and WO-A-2010/107613. In these types of smoking articles, a chemical source is provided to generate the nicotine-containing aerosol.

In any case, the smoking article may comprise portions, such as a filter, a tobacco rod, or a cartridge, that is subsequently assembled into the smoking article. As used herein, reference to treating a smoking article includes both the treatment of an entire assembled smoking article and the treatment of a portion of the smoking article that can subsequently be assembled to yield a smoking article.

A further benefit is that the movability of the needle, in particular together with a needle holder, can also be used to generate a pressure which allows the provision of the treatment substance to the smoking article. In some embodiments this can be attained by means of a plunger. In other embodiments it may also be possible to operate a pump or other fluid conveying means when the needle holder is moved. The injection pressure may be provided solely by the force applied for the movement for the needle holder. In other embodiments, it is also possible to provide all or a portion of the injection pressure by means of an electrical drive or a mechanical element that stores or transmits energy, such as a spring.

The movement of the needle holder is preferably affected by means of manual force of the operator applied to a handle element connected to the needle or to an element which moves together with the needle. In particular, a gripping element may be provided, which is accessible from the outside of the treatment device, and allows moving the needle. Alternatively, or in addition to the manual force, movement of the needle holder may be affected by an electrical drive or mechanical element that stores or transmits energy.

In a preferred embodiment, the treatment device is configured to inject a treatment substance through the needle into a smoking article while the needle is moved with respect to the smoking article. Thus, the injection and the movement is carried out simultaneously, and a beneficial continuous distribution of the treatment substance is obtained along at least a portion of the length of the smoking article. In other embodiments, it is also possible to carry out the movement and the injection subsequently to inject the treatment substance at a variety of discrete locations in the smoking article.

In a preferred embodiment, the treatment device is a flavouring device. Thus, it will apply a flavouring substance as a treatment substance into the smoking article. The flavouring substance is preferably menthol. Preferably, the flavouring substance is a flavourant provided in a liquid carrier.

A variety of flavours could be used in the treatment device. In some embodiments, the flavourant is a high potency flavourant, and is typically used at levels that would result in less than 200 parts per million when the smoking article is used. Examples of such flavourants are key tobacco aroma compounds such as beta-damascenone, 2-ethyl3,5-dimethylpyrazine, phenylacetaldehyde, guaiacol, and furaneol. Other flavourants can only be sensed by humans at higher concentration levels. These flavourants, which can be referred to as the low potency flavourants, are typically used at levels that result in orders of magnitude higher amounts of flavourant released into the smoke. Suitable low potency flavourants include, but are not limited to, natural or synthetic menthol, peppermint, spearmint, coffee, tea, spices (such as cinnamon, clove and ginger), cocoa, vanilla, fruit flavours, chocolate, eucalyptus, geranium, eugenol and linalool. Preferably, the flavourant includes an essential oil, or a mixture of one or more essential oils. An "essential oil" is a volatile oil having the characteristic odour and flavour of the plant from which it is obtained. Suitable essential oils for inclusion in the flavour granules of the present invention include, but are not limited to, peppermint oil and spearmint oil.

In the alternative, or in addition to flavouring substances, the treatment substance may comprise one or more other functional substances. These functional substances may be used to hinder the formation of, or capture certain smoke constituents. Thus, the treatment substance can also provide the benefit of reducing or removing smoke constituents.

The treatment substance may be a liquid, a solid, a gas, or any combination of these states.

Preferably, the treatment device is configured to inject the treatment substance when the needle is moved from the extended position to the retracted position. Thus, the treatment substance is injected while the needle is retracted from the smoking article. In this way, the needle may interfere less with the injected treatment substance. Furthermore, the injection process is finished when the needle is in the retracted position, such that the operator can immediately remove the smoking article from the treatment device.

In a preferred embodiment, the needle and the needle holder are attached to a sliding means, which is slidable in between the extended position and the retracted position in the needle storage portion. The sliding movement may be a linear movement, which allows the insertion of the needle to be minimally invasive to the smoking article and the smoking material of the smoking article. In particular, the needle has a longitudinal axis that is aligned with the sliding direction of the sliding means.

Preferably, the smoking article receiving portion is adapted to hold the smoking article such that a longitudinal axis of the smoking article is substantially aligned with the sliding direction of the sliding means or substantially parallel to the sliding direction of the sliding means. This allows the needle to be moved along the smoking article to distribute the treatment substance along all or portion of the smoking article. In particular, the sliding direction, the needle and the smoking article receiving portion (and therefore the smoking article) may all be aligned or parallel.

In a preferred embodiment, the sliding means provides a cartridge seat for holding a cartridge comprising a treatment substance. The cartridge enables significant benefits regarding the provision of the treatment substance, as it is not necessary to clean a storage chamber or the device after each treatment operation. This allows in particular that different treatment substances, for example different flavouring substances, can be used subsequently with the same treatment device. In a preferred embodiment, the cartridge comprises the amount of treatment substance for the treatment of one smoking article. However, in other embodiments, it is also possible to provide a cartridge which allows several subsequent treatment operations for several smoking articles. In one embodiment the cartridge has a cylindrical form, however, in other embodiments, the cartridge may have a rectangular or other cross-sectional shape. The treatment device may provide a cartridge storage compartment for storing several unused or used cartridges.

In other embodiments it is also possible to provide a storage chamber for the treatment substance, which can preferably be refilled.

In some embodiments, the cartridge may comprise the needle, and may be connected to a needle holder which is initially not provided with a needle. This allows that a new, clean needle can be provided for the treatment operation. However, generally it is preferred that the needle holder and the needle can be separated from the cartridge.

The needle on the needle holder is preferably exchangeable by the operator. Nevertheless, for treatment devices which should be cost efficient, the needle is directly included or permanently fixed in the needle holder, such as provided during injection moulding or welded into same.

Preferably, one end of the needle is attached to the cartridge seat, while the other end of the needle is adapted to be inserted into the smoking article. Thus, the needle comprises two tips, the first of which is designed to be inserted into the smoking article, while the second tip is attached to the cartridge seat and has an opening to provide fluid communication between the cartridge and another portion of the needle, for example the first tip. The cartridge has at least one side wall which is adapted to be perforated by the needle, such that the needle protrudes into the inside of the cartridge, wherein the treatment substance is stored.

The needle storage portion preferably comprises a lid with a closed and an open configuration. In the open configuration, the lid allows for inserting and removing the cartridge into and from the needle storage portion, in particular into and from the cartridge seat. In the closed configuration, the needle and cartridge are obscured during the treatment operation such that the user is protected.

In one embodiment, the smoking article receiving portion comprises a receiving space for the smoking article with an abutment wall arranged at the opposite side with respect to the needle storage portion, wherein the abutment wall is configured to hold the smoking article during insertion of the needle. The force applied to the smoking article by the needle during the insertion of the needle while moving the needle from the retracted position to the extended position is transmitted to the abutment wall so that the smoking article remains in position. During the retraction of the needle from the extended position to the retracted position an abutment wall may be provided at the opposite side of the smoking article receiving portion, wherein the latter abutment wall comprises a hole through which the needle can be moved.

The smoking article receiving portion may be closable by a lid, in particular a hingeable or slidable lid. When the lid is open, the lid allows for inserting and removing the smoking article into and from the smoking article receiving portion. When the lid is closed, the smoking article is protected and safely held during the treatment operation, and the user may be further protected from the needle.

The needle storage portion comprises in some embodiments a stationary plunger, which extends in the sliding direction of the sliding means and is configured to be inserted into a cartridge by means of a sliding motion of the sliding means. Thus, the cartridge moves together with the sliding means towards the stationary plunger, which is received in a plunger receiving means of the cartridge, and thus applies pressure to the treatment substance comprised in the cartridge, such that the treatment substance is provided through the needle to the smoking article. Thus, the cartridge can have a compact design, as it does not have to provide a plunger of its own, which would usually be in the extended position when the cartridge is in its filled state.

In one embodiment, the needle storage portion is movable relative to the smoking article receiving portion, such that at least one dimension of the treatment device may be reduced. Usually, both the needle storage portion and the smoking article receiving portion have a longer longitudinal length in the direction of the movement of the needle holder than width or height, and are arranged consecutively in the longitudinal direction during the treatment operation. Thus, to reduce the size of the device in a storage configuration, it is preferred to move the needle storage portion, such that finally both devices are arranged along side one another.

Preferably, the needle storage portion is arranged slidable on the smoking article receiving portion. The slidability may be provided only in two directions such that two slidable movements are able to be carried out subsequently. Preferably, the slidability is enabled by providing tracks on the outside of each of the needle storage portion and smoking article portion, such that the devices can be slid along each other, while still being connected to each other by means of the tracks. Preferably, the tracks are provided at two side surfaces which share a corner at each of the needle storage portion and smoking article receiving portion, respectively. Alternatively, the needle storage portion and the smoking article receiving portion are attached to one another with a hinge and the two portions may be rotatable with respect to one another between a storage configuration and a treatment configuration.

Furthermore, an interlock may be provided when the smoking article receiving portion is in the storage position, such that the sliding means is locked in a retracted position. Further, an interlock can be provided to lock the sliding means in the retracted position when the smoking article receiving portion is open.

Also, it is possible to provide an interlock to prevent opening of the smoking article receiving portion when the sliding means is in the extended position. An interlock may further be provided to prevent movement of the sliding means when the needle storage portion is open.

In one embodiment, the smoking article receiving portion is configured to receive a rod-shaped smoking article with a greater longitudinal length than width, and the needle is adapted to be inserted centrally along the longitudinal length of the smoking article. Rod-shaped smoking articles include smoking articles such as cigarettes and cigars.

The object of the invention is also attained by a cartridge for a treatment device as specified above, wherein the cartridge comprises a treatment substance for a smoking article. According to the invention, the cartridge comprises a plunger receiving means which is configured to receive a plunger to force the treatment substance out of the cartridge. Further, the cartridge has a side wall which is adapted to be perforated by a second end of the needle, such that the second end of the needle may protrude into the inside of the cartridge, wherein the treatment substance is stored. In particular, the cartridge is a disposable item of low cost, which can be used together with a reusable treatment device, such that a variety of treatment operations can be conducted, while it is only necessary to replace the cartridges. The plunger receiving means is configured to receive a plunger, wherein the plunger is inserted into the plunger receiving means by the movement of the needle holder, such that the treatment substance is forced out of the cartridge.

In particular, the cartridge comprises a sealed opening or a penetrable surface on one end thereof, in which a docking part connected to the needle holder can be inserted, such that the treatment substance of the cartridge can be forced into the needle. The docking part may be a rear end of the needle which protrudes from the needle holder. The side walls of the cartridge preferably have a higher stability, such that they can bear the pressure while the plunger is operated. The sealed opening or penetrable surface and the plunger receiving means are preferably provided at opposite sides of the cartridge.

Preferably, the cartridge has a cylindrical form. However, in other embodiments the cartridge may have a rectangular or other cross-sectional shape.

The cartridge does not need to comprise a plunger of its own, as the plunger can be provided in the needle storage portion of the previously described treatment device.

In one embodiment however, the cartridge comprises a plunger in the plunger receiving means, which protrudes from the cartridge and is adapted to be inserted into the cartridge to force the treatment substance out of the cartridge. Such a plunger may be maintained outside the plunger receiving means prior to use or it may extend partially into the plunger receiving means. In use, the plunger is then inserted into, or further inserted into, the plunger receiving means to force the treatment substance from the cartridge.

Furthermore, the invention also relates to a method for treating a smoking article, in particular with a handheld treatment device as specified above, which comprises arranging a smoking article in a smoking article receiving portion of a treatment device, and moving the needle of a needle storage portion of the treatment device from an extended position, in which the needle extends at least partially into the smoking article receiving portion, to a retracted position, in which the needle is retracted into the needle storage portion.

The method may further comprise the step of moving the needle from the retracted position into the extended position while a smoking article is arranged in the smoking article receiving portion such that the needle is inserted into the smoking article. A cartridge, which contains the treatment substance, may be placed in the needle storage portion, and the treatment substance is forced out of the cartridge and through the needle into the smoking article during the movement of the needle from the extended position to the retracted position.

The invention also relates to any combination of any of the previously described treatment devices and cartridges.

The invention will be further described by means of example only with reference to the figures, wherein.

Figure 1:
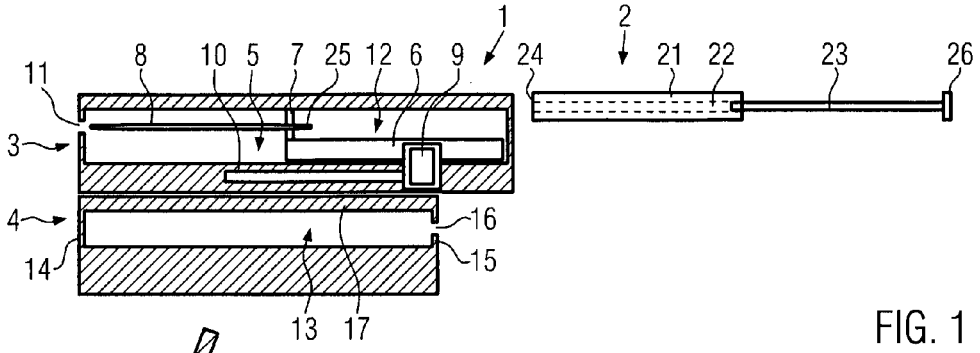
FIG. 1 shows a sectional view of a first embodiment of the treatment device and the cartridge, wherein the needle storage portion of the treatment device is in a storage position.

FIG. 1 shows an embodiment of the treatment device 1 and the cartridge 2 according to the present invention in a sectional view, before the cartridge 2 is inserted into the treatment device 1. The treatment device comprises a needle storage portion 3 and a smoking article receiving portion 4, which are separate parts and movable with respect to each other. In FIG. 1, the smoking article receiving portion 4 is arranged in a storage position, which is below the needle storage portion 3. The needle storage portion 3 comprises a needle storage space 5, in which a sliding means 6, with a needle holder 7 and a needle 8 are arranged. The needle storage portion 3 includes enclosure means in the form of one or more walls which enclose the retracted needle 8, such that the operator is protected from the needle 8. The enclosure means are provided to prevent the operator from reaching into the needle space 5. Thus, the needle storage space 5 is at least partially defined by the one or more walls of enclosure means. The needle storage space 5 is open at its front end towards the smoking article receiving portion 4 to allow the needle 8 to be moved into the smoking article receiving portion 4. The needle storage space 5 is further open at its rear end to allow the sliding means 6 to move. At the side of the sliding means 6 a gripping element 9 is provided, which is accessible from outside the needle storage portion 3, such that the operator of the treatment device can slide the sliding means 6 together with the needle holder 7 and needle 8 in the horizontal direction in the figure. Therefore, a slot in the horizontal direction may be provided in the outer housing of the needle storage portion 3, which is not shown in FIG. 1, as it is a sectional schematic view. The gripping element 9 has an engagement protrusion which engages in a sliding track 10 provided in the slot of the needle storage portion 3 and guides the sliding movement. The needle storage portion 3 further comprises an opening 11, through which the needle 8 protrudes, when the needle holder 7 is moved together with the sliding means 6 to the extended position. A cartridge seat 12 is formed by the sliding means 6 together with the needle holder 7, into which the cartridge 2 can be inserted as it will be explained below.

The smoking article receiving portion 4 comprises a smoking article receiving space 13 which is delimited on its left side by an abutment wall 14, and on its right side by an abutment wall 15 which comprises an opening 16, through which the needle 8 can be inserted, when the smoking article receiving portion 4 is in the operating position.

Figure 2:
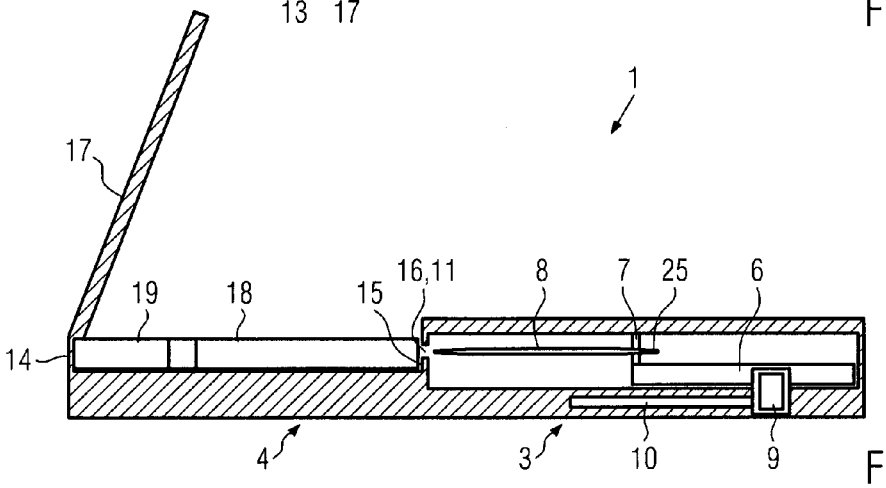
FIG. 2 shows a sectional view of the treatment device according to the first embodiment, wherein a smoking article is provided in the smoking article receiving portion and the needle storage portion is provided in an operating position.

In FIG. 1, the upper side of the smoking article receiving portion 4 is in sliding engagement with the lower side of the needle storage portion 3, such that the smoking article receiving portion 4 may be slid to the left side, such that the upper right corner of the smoking article receiving portion 4 and the lower left corner of the needle storage portion 3 are in the vicinity of each other. The smoking article receiving portion 4 further comprises sliding means on its right side, while the needle storage portion comprises sliding means on its left side, such that when the smoking article receiving portion 4 is in the leftmost position, the smoking article receiving portion 4 can be moved upwards. Then, the smoking article receiving portion 4 and the needle storage portion 3 are aligned with each other, as shown in FIG. 2, wherein in particular the openings 11 and 16 are aligned. The means enabling the sliding in between the smoking article receiving portion 4 and the needle storage portion 3 are in particular protrusions which are provided on one of the two portions, and which engage in tracks in the other of the two portions.

In another embodiment, a hinge is provided in between the upper left corner of the smoking article receiving portion 4 in the storage position as shown in FIG. 1 and the lower left corner the needle storage portion 4, with a hinge axis perpendicular to the figure plane, such that by means of rotation, the smoking article receiving portion 4 can be brought into the same alignment as shown in FIG. 2. Therefore, the location of the smoking article receiving space 13 and the opening 16 has to be accordingly amended.

The smoking article receiving portion 4 comprises a hinged lid 17, which is provided on the top of the smoking article receiving portion 4, and allows in its opened state, as shown in FIG. 2, the insertion of a smoking article 18 into the smoking article receiving space 13. The smoking article 18 extends horizontally in its longitudinal length as shown in FIG. 2, and abuts with its longitudinal ends against the abutment walls 14, 15. In particular, the smoking article 18 is a cigarette comprising a filter tip 19, which abuts against the abutment wall 14 provided on the opposite side with respect to the needle storage portion 3, while the longitudinal front end of the smoking article 18, which is designated to be lit by the consumer at a later stage abuts at the abutment wall 15. The abutment wall 15 comprises the opening 16 and is arranged adjacent to the needle storage portion 3. The opening 16 is aligned with the center of the tip of the smoking article 18.

Figure 3:
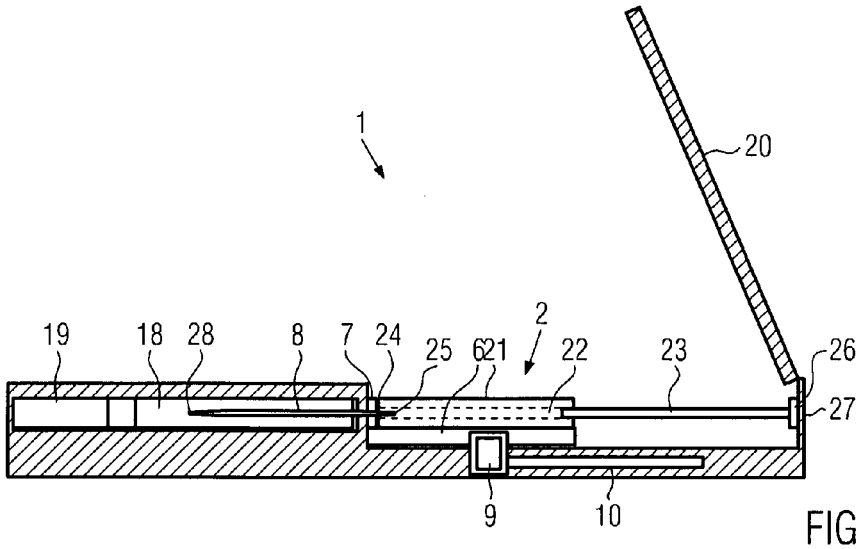
FIG. 3 shows a sectional view of the first embodiment of the treatment device before the injection process, wherein the cartridge is inserted in the needle storage portion.

After the insertion of the smoking article 18 the hingeable lid 17 is closed, such that the smoking article 18 is snugly accommodated in the smoking article receiving space 13 as shown in FIG. 3.

Then, the sliding means 6 is slid together with needle holder 7 and the needle 8 in the direction of the smoking article, such that the needle penetrates the smoking article 18 centrally in a longitudinal direction, wherein the tip of the needle extends at the end of the sliding motion far into the smoking material filled portion of the smoking article 18, being close to the beginning of the filter tip 19 of the smoking article 18. The force for the sliding movement is applied by the operator to the gripping element 9. The end of the sliding motion can either be determined by the end of the track 10 or by an abutment of either the sliding means 6 or the needle holder 7 against the inner lateral walls of the needle storage portion 3.

In FIG. 3, the fully extended position of the needle 8 is shown in which the needle 8 extends into the smoking article 18. In this position a hinged lid 20 can be opened and the cartridge 2 can be inserted into the cartridge seat 12 provided by the sliding means 6 and needle holder 7.

The cartridge 2 comprises a storage portion 21 which is filled with the treatment substance 22, which in the present case is a liquid comprising menthol. Furthermore, the cartridge 2 comprises a plunger 23, which is provided in its fully extended position as shown in FIGS. 1 and 3, when the cartridge is in its filled state. In its fully extended position, the plunger 23 projects only slightly into the storage portion 21, such as to provide a stable connection in between the storage portion 21 and the plunger 23. On the side opposite the plunger 23, the storage portion 21 comprises an abutment surface 24, which is able to be penetrated by a rear section 25 of the needle 8, which extends into the cartridge seat 12. The rear section 15 of the needle 8 may be provided within a protection means, such as a cylindrical protruding wall, which covers the rear section 25 of the needle 8 to prevent any injury of the operator, while being large enough to allow the insertion of the cartridge 2. The plunger 23 has an end that is opposite the storage portion 21, and this opposite end defines an abutment surface 26, which is configured to abut the inside of the right wall 27 of the needle storage portion 3.

In FIG. 3, the cartridge 2 is shown inserted into the cartridge seat 12, wherein the abutment surface 26 is in contact with the rear wall 27 of the needle storage portion 3, which is at the right side in FIG. 3. The left abutment wall 24 of the storage portion 21 is in contact with the needle holder 7, while the rear section 25 of the needle 8 extends into the treatment substance 22.

Figure 4:
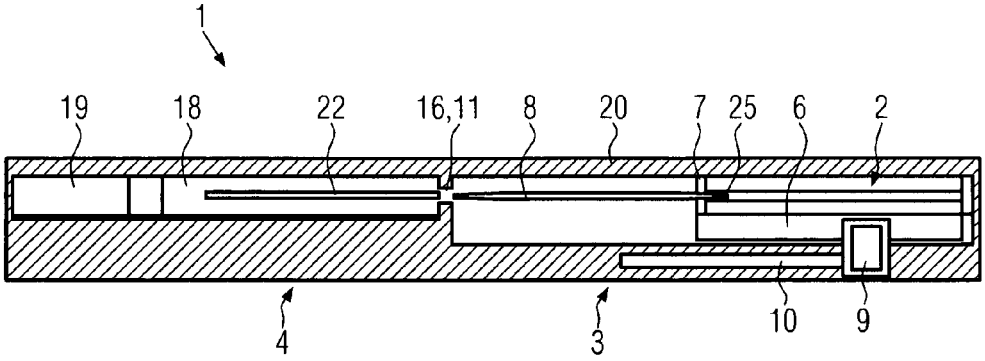
FIG. 4 shows a sectional view of the first embodiment of the treatment device after the injection process, wherein the needle holder is in the retracted position.

Then, the hinged lid 20 of the needle storage portion 3 is closed and the sliding means 6 is retracted, such that the needle 8 is brought into the retracted position which is shown in FIG. 4, wherein the needle 8 is fully retracted into the needle storage portion 3. The needle 8 comprises an opening 28 at its tip, and while the needle 8 is retracted from the smoking article 18 by the sliding movement of the sliding means 8 from the extended position to the retracted position, the plunger 23 is inserted into the storage portion 21 of the cartridge 2, such that the treatment substance 22 is distributed continuously along a line inside the smoking article 18. The end of the insertion process and the distribution of the treatment substance 22 in the smoking article 18 can be seen in FIG. 4.

The hinged lid 20 is then opened and the cartridge can be removed from the cartridge seat 12 in the needle storage portion 3. If the operator does not plan to provide the treatment substance to another smoking article, he can slide the smoking article receiving portion 4 back into the storage position as shown in FIG. 1.

Figure 5:
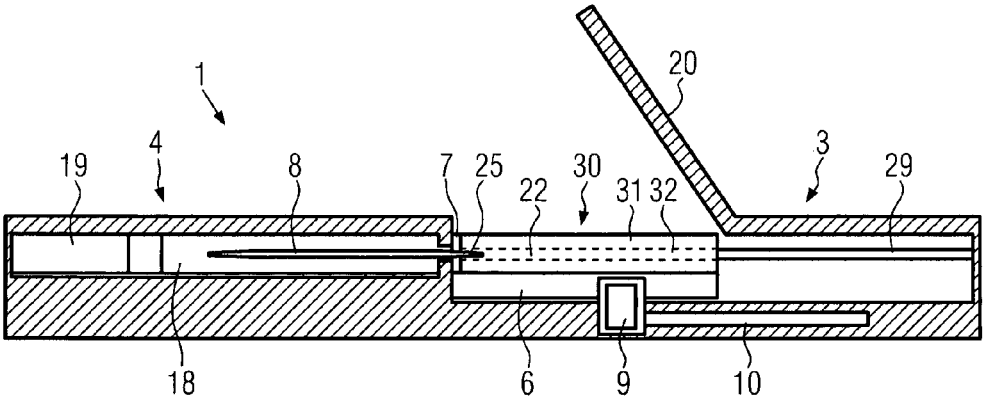
FIG. 5 shows a sectional view of a second embodiment of the treatment device, wherein a cartridge is inserted in the needle storage portion.

In FIG. 5 a second embodiment of the treatment device 1 is shown in cross section, wherein the differences will be explained in the following, while apart from these differences the general setup of the device is preferably identical to the previously described device. In contrast to the first embodiment, the needle storage portion 3 comprises a stationary plunger 29 which is fixed to the right side wall of the needle storage portion 3 or may be an integral part of the needle storage portion 3. The plunger 29 is arranged such that it is aligned with the cartridge 13, when same is inserted into the cartridge seat 12 on the sliding means 6. The cartridge 2 consists of a storage portion 31 in which the treatment substance 22 is provided in a storage space 32. This storage space 32 has substantially the same cross-section as the plunger 29, or the same cross-section as the left most end section of the plunger 29. The plunger 29 and the storage space 32 are aligned, such that the plunger 29 is adapted to force the treatment substance 22 out of the storage space 32 of the cartridge 30, when the cartridge 2 is retracted from the extended position of the needle 8 as shown in FIG. 5, to a retracted position as similarly shown for the first embodiment in FIG. 4. During the sliding motion the treatment substance 22 will be injected into the smoking article 18, such that at the end of the sliding process the smoking article 18 will be provided with treatment substance along a line as shown in FIG. 4.

The invention is also directed to a combination of a treatment device 1 with the cartridge 2 as described.

The treatment device has an approximate height of 25 mm as shown in the vertical direction in the drawings, an approximate width of 25 mm in the direction perpendicular to the figure plane, and an approximate length of 100 mm in the horizontal direction of the drawings, when it is in the operating position as shown in FIG. 4. Preferably, the device is made of plastic material, while the needle 8 is made from stainless steel.

The treatment device 1 may comprise an additional compartment (not shown) to store several cartridges.

In one embodiment, several needles 8 may be provided on one sliding means, and several smoking articles 18 may be provided in the smoking article receiving portion, such that by only one sliding operation, several smoking articles may be provided with treatment substance.

The approximate length of the storage portion 21, 31 of the cartridge 2, 30 is 50 mm, while it contains approximately 10 to 15 microliters of liquid flavouring substance.

In one embodiment, the needle storage portion 3 and the smoking article receiving portion 4 may be part of one integral treatment device 1 and not moveable relative to each other.

In another embodiment the needle storage portion 3 and the smoking article receiving portion 4 may be separate elements, which can be fixed to each other in either the storage position or operating position.

The closable openings for the needle storage portion 3 and smoking article receiving portion 4, which have been described as hingeable lids 17, 20, may as well be slideable or rotable lids, wherein a sliding or rotating motion opens the respective portion of the treatment device.

The needle may be a replaceable part, which can be exchanged on the needle holder. In some embodiments, the length of the needle and the sliding motion may be adapted, such that the treatment substance is only or additionally injected in the filter tip 19 of the smoking article 18.

The invention claimed is:

1. A handheld treatment device for a smoking article, comprising:

a smoking article receiving portion shaped and configured to receive at least a portion of a smoking article; and a needle storage portion with a needle holder and a needle connected to the needle holder, the needle storage portion comprises an enclosure having one or more walls that enclose the retracted needle, to protect an operator from the needle;

wherein the needle is movable between an extended position in which the needle extends at least partially into the smoking article receiving portion and a retracted position in which the needle is fully retracted into the needle storage portion with respect to the extended position, to protect an operator from the needle; and wherein the treatment device is configured to inject a treatment substance through the needle into a smoking article while the needle is moved with respect to the smoking article.

2. The treatment device according to claim 1, wherein the treatment device is configured to inject the treatment substance when the needle is moved from the extended position to the retracted position.

3. The treatment device according to claim 2, wherein the needle holder is attached to a sliding element, which is slideable between the extended position and the retracted position.

4. The treatment device according to claim 3, wherein the smoking article receiving portion is adapted to hold the smoking article in an orientation substantially parallel to the sliding direction of the sliding element.

5. The treatment device according to claim 3, wherein the sliding element comprises a cartridge seat for holding a cartridge comprising a treatment substance.

6. The treatment device according to claim 5, wherein a first end of the needle is adapted to be inserted into the smoking article and a second end of the needle extends into the cartridge seat.

7. The treatment device according to claim 1, wherein the needle storage portion comprises a lid that can be moved between an open configuration and a closed configuration, the open configuration facilitating the insertion and removal of a cartridge into and from the needle storage portion.

8. The treatment device according to claim 1, wherein the smoking article receiving portion comprises a receiving space for the smoking article with an abutment wall arranged at the opposite side with respect to the needle storage portion, wherein the abutment wall is configured to hold the smoking article during insertion of the needle.

9. The treatment device according to claim 3, wherein the needle storage portion comprises a stationary plunger, which extends in the sliding direction of the sliding element and is configured to be inserted into a cartridge by the sliding motion of the sliding element.

10. The treatment device according to claim 1, wherein the needle storage portion and the smoking article receiving portion are movable with respect to one another between an operating configuration and a storage configuration in which at least one dimension of the treatment device is smaller than in the operating configuration.

11. The treatment device according to claim 10, wherein the needle storage portion and the smoking article receiving portion are slidable with respect to one another between the operating configuration and the storage configuration.

12. The treatment device according to claim 1, wherein the smoking article receiving portion is configured to receive a rod-shaped smoking article with a higher longitudinal length than width, and the needle is adapted to be inserted centrally along the longitudinal length of the smoking article.

13. The treatment device according to claim 4, wherein the sliding element comprises a cartridge seat for holding a cartridge comprising a treatment substance.

14. The treatment device according to claim 2, wherein the needle storage portion comprises a lid that can be moved between an open configuration and a closed configuration, the open configuration facilitating the insertion and removal of a cartridge into and from the needle storage portion.

15. The treatment device according to claim 4, wherein the needle storage portion comprises a lid that can be moved between an open configuration and a closed configuration, the open configuration facilitating the insertion and removal of a cartridge into and from the needle storage portion.

16. The treatment device according to claim 4, wherein the needle storage portion comprises a stationary plunger, which extends in the sliding direction of the sliding element and is configured to be inserted into a cartridge by the sliding motion of the sliding element.

* * * * *